United States Patent [19]

Miska

[11] Patent Number: 5,050,300

[45] Date of Patent: Sep. 24, 1991

[54] ELECTRIC DRY SHAVER HAVING AN IMPROVED SEALING ARRANGEMENT

[75] Inventor: Aivars Miska, Stratford, Conn.

[73] Assignee: Remington Products, Inc., Bridgeport, Conn.

[21] Appl. No.: 908,325

[22] Filed: Sep. 17, 1986

[51] Int. Cl.[5] ..... B26B 19/06

[52] U.S. Cl. ..... 30/34.1

[58] Field of Search ..... 30/34.1, 34.2, 34, 43.92, 30/43.6; 123/198 E; 277/235 B, 212 FB

[56] References Cited

U.S. PATENT DOCUMENTS 4,050,151 9/1977 deBoer et al. ..... 30/34.1

4,426,776 1/1984 Kakumoto et al. ..... 30/34.1

*Primary Examiner*—Douglas D. Watts

[57] ABSTRACT

A resilient sealing means is provided in an electric dry shaver to restrict the entry of shaver cuttings and foreign debris into the interior of the shaver housing. The resilient means is positioned in an aperture of the housing through which the short hair cutter and hair trimmer actuating members extend. The resilient sealing means includes apertures through which these members extend and fits snugly with the members. The sealing means seals the housing in top wall segments and side wall segments.

4 Claims, 3 Drawing Sheets

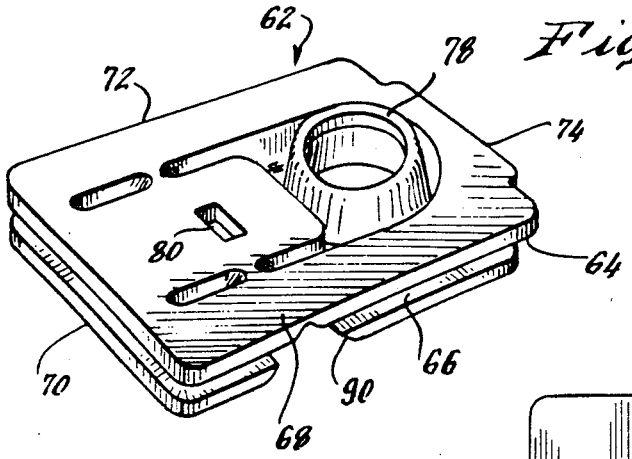
Fig. 1.
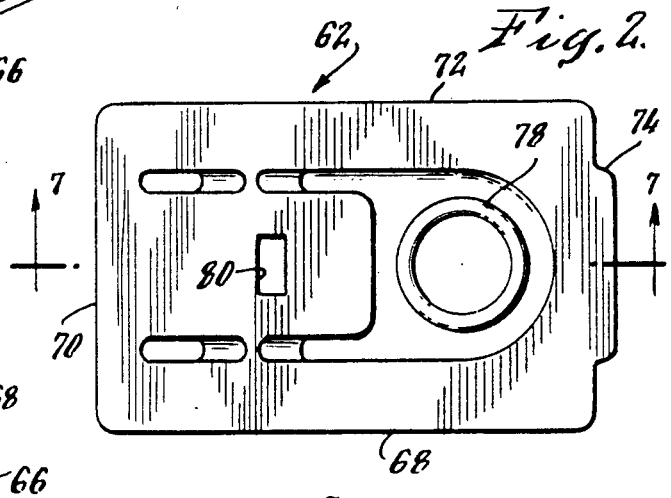
Fig. 2.
Fig. 5.
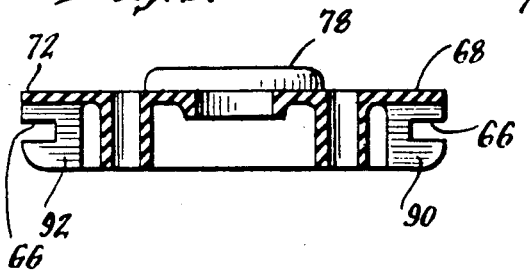
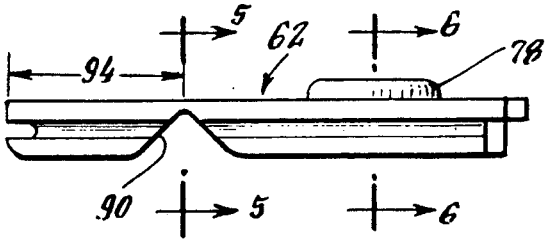
Fig. 3.
Fig. 6.
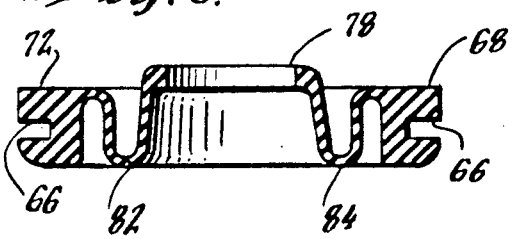
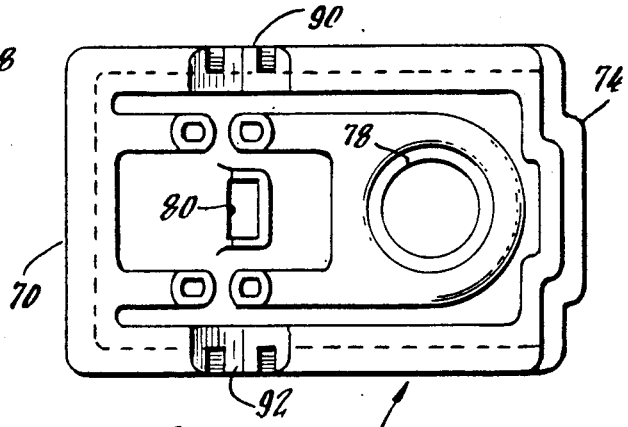
Fig. 4.
Fig. 7.
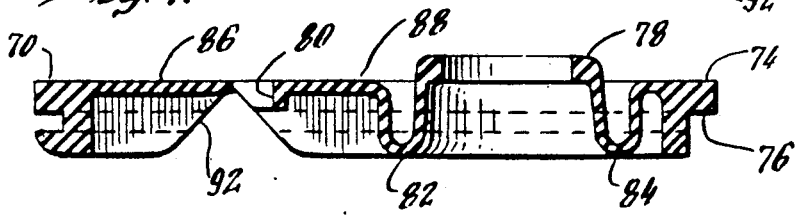

20
60
38
32
75
48
30
62
54
44
42
34
46
40
30
73
38
29
31
24
28
26
29
22

ELECTRIC DRY SHAVER HAVING AN IMPROVED SEALING ARRANGEMENT

BACKGROUND OF THE INVENTION

1. Field of the Invention

This invention relates to electric dry shavers. The invention relates more particularly to an improved arrangement for sealing the interior of the shaver from shaver cuttings and foreign debris.

2. Description of the Prior Art

Electric dry shavers are known which include a shaver head having a short hair cutter for shaving relatively short facial hairs and a hair trimmer for shearing relatively longer hairs. One known type is a foil shaver wherein the short facial hair cutter comprises a stationary, apertured, outer foil cutter member and an inner assembly of cutter blades. The inner assembly reciprocates relative to the stationary foil and, in cooperation therewith, shears short facial hairs which extend through the foil apertures. The hair trimmer includes a stationary comb member and a moveable cutter member, each having a plurality of teeth. Reciprocating motion is established between these comb and cutter members and relatively longer body hairs which extend between the reciprocating teeth are sheared. In one arrangement, the short hair cutter and the hair trimmer are simultaneously actuated by mechanical coupling to the same electric motor. An electric dry shaver of this type is disclosed in U.S. Pat. No. 4,089,109.

In a particular design of a cutter head, the mechanical coupling between an electric drive motor and the short hair cutter and trimmer is arranged for providing that the short hair cutter and trimmer cutter each reciprocate simultaneously but in opposite directions. This enhances the operation of the shaver by providing a substantial balanced mechanism while at the same time improving the feel of the shaver to the user.

In order to couple an actuating force from an internal drive motor to the cutter head, an aperture is formed in the housing through which drive segments extend from within the housing to the cutter head. The aperture is of sufficient size so as to enable the drive segments to traverse a course during their reciprocating motion. Consequently, an entry undesirably exists which could permit the passage of hair particles and other foreign debris into the interior of the housing. This can result in contamination of various internal shaver components, binding of the mechanism and can lead ultimately to a malfunction of the shaver.

As a means of restricting the entry of the shaver cuttings and foreign debris, a sealing means has been provided which enables the desired reciprocating motion of the drive members while at the same time limits the passage of debris into the housing. The sealing means have been in the form of plastic foam shields which are positioned at the aperture and through which the drive members extend. Over a period of time, the sealing means becomes saturated with entrapped debris which in combination with shaving lotion and other liquids tends to harden and thus reduce the effectiveness of the shaver. This increases the loading on the shavers and in the case of battery-operated shavers, reduces the effective usage of the shaver between battery chargings.

In one form of shaver of the type described, the drive member for the trimmer extends parallel to and substantially adjacent to a side wall of the shaver. This relative adjacent positioning of the drive member and the wall reduces effective debris sealing.

SUMMARY OF THE INVENTION

Accordingly, it is an object of this invention to provide an improved means for reducing the entry of shaver particles and foreign debris into the interior of a shaver housing.

Another object of the invention is to provide an improved means for sealing an aperture through which both small hair cutter and long hair trimmer actuating members extend.

A further object of the invention is to provide an improved debris sealing means for an electric dry shaver having short hair cutter and long hair trimmer actuating members extending through a same aperture and reciprocating in mutually opposite directions.

Still another object of the invention is to provide a debris sealing means for a battery-operated electric drive shaver having trimmer and short hair cutter actuating members extending through an aperture in the shaver housing.

A further object of the invention is to provide a debris sealing means for an electric dry shaver for use with short hair and long hair trimmer members reciprocating in opposite directions and which reduces loading imposed by the sealing means on a drive motor.

Still another object of the invention is to provide a debris sealing means for use with an electric dry shaver having a short hair cutter and a long hair trimmer wherein an actuating member of the trimmer is positioned closely adjacent to a wall of the shaver housing.

Another object of the invention is to provide an improved electric dry shaver.

In accordance with the features of the invention, an electric dry shaver includes a housing having a cutter head positioned at one end of the housing. The cutter head includes a short hair cutter and long hair trimmer. An electrically energized actuating means for imparting reciprocating motion to the cutters is provided which includes first and second drive members for engaging the cutters and trimmers, respectively. The housing includes a wall thereof and an aperture formed in the wall at the end of the housing. Drive members extend from within the housing and through the aperture and a sealing body is provided for inhibiting passage of shaving debris and foreign materials through the aperture into the interior of the housing.

The sealing body is formed of a resilient material having integral segments of different thicknesses. The sealing body includes first and second segments having first and second apertures, respectively formed therein. These apertures are sized to provide for the snug extension of the cutter and trimmer drive members, respectively through the aperture in the sealing body. The sealing body further includes integral, peripheral segments formed for engaging the housing wall, and, integral thin wall segments for coupling the aperture segments to the mounting segments. The thin wall segments provide a flexible hinge between the aperture segments and the mounting segments.

In accordance with another feature of the invention, the aperture for the trimmer actuating member is formed in top and side wall segments of the housing. The trimmer actuating member is positioned adjacent the aperture in the side wall segment. The sealing body includes a segment which seals the aperture in the top wall segment and extends at an angle to and seals the aperture in the side wall segment.

BRIEF DESCRIPTION OF THE DRAWINGS

These other objects and features of the invention will become apparent with reference to the following specification and to the drawings wherein:

FIG. 1 is an enlarged, perspective view of a debris sealing body constructed in accordance with features of this invention;

FIG. 2 is a top plan view of the sealing body of FIG. 1;

FIG. 3 is a side elevation view of the sealing body of FIG. 2;

FIG. 4 is a bottom plan view of the sealing body of FIG. 1;

FIG. 5 is a view taken along Line 5—5 of FIG. 3;

FIG. 6 is a view taken along Line 6—6 of FIG. 6;

FIG. 7 is a view taken along Line 7—7 of FIG. 2;

DETAILED DESCRIPTION

Figure 8:
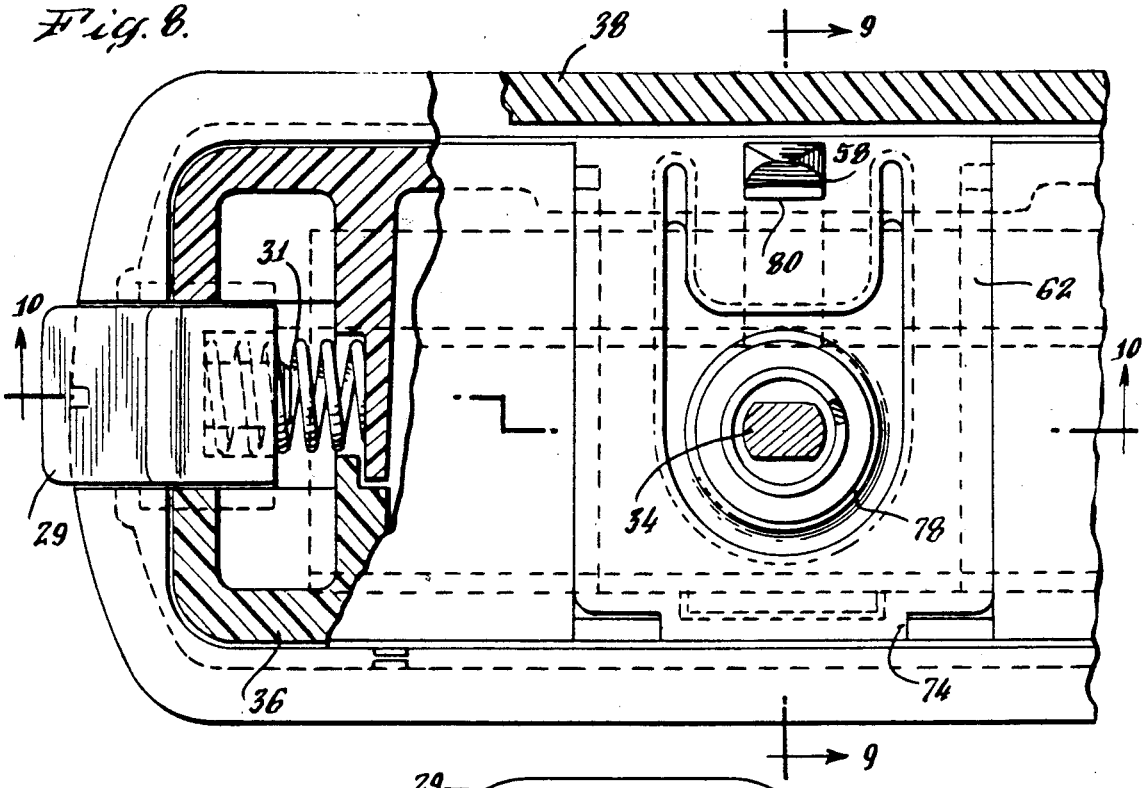
FIG. 8 is an enlarged, fragmentary, top plan view of an electric dry shaver constructed in accordance with features of this invention.
Figure 9:
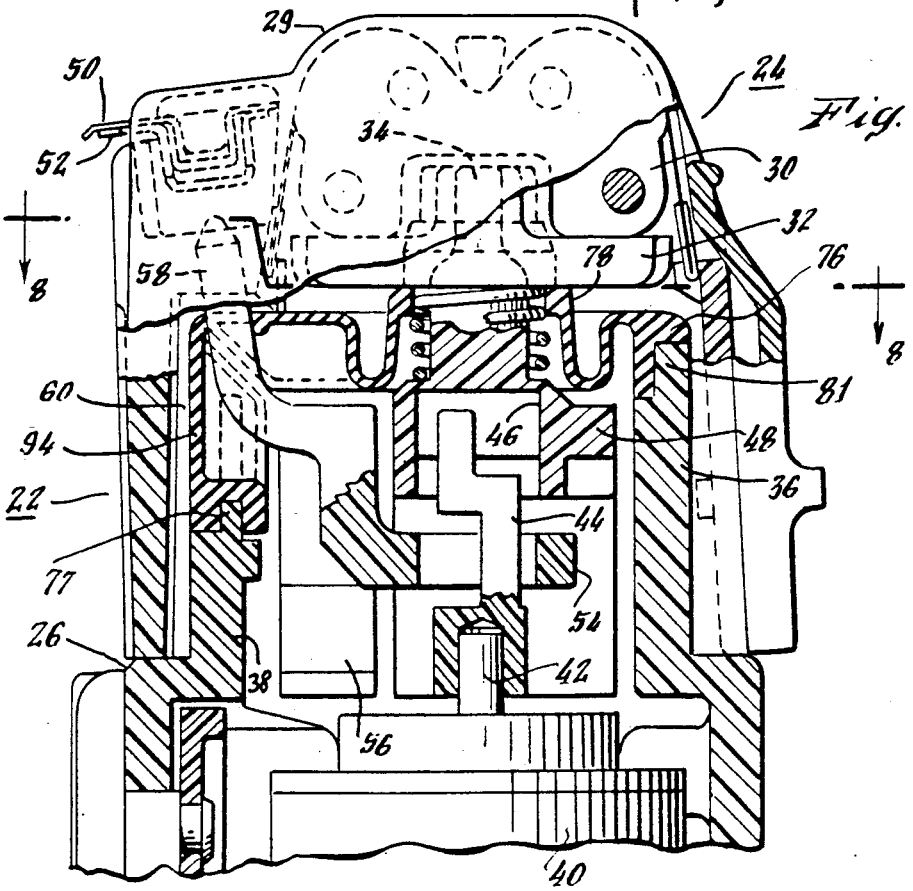
FIG. 9 is a fragmentary, partly broken-away view taken along Line 9—9 of FIG. 8; and, FIG. 10 is an enlarged, partly broken-away view taken along Line 10—10 of FIG. 8.
Figure 10:
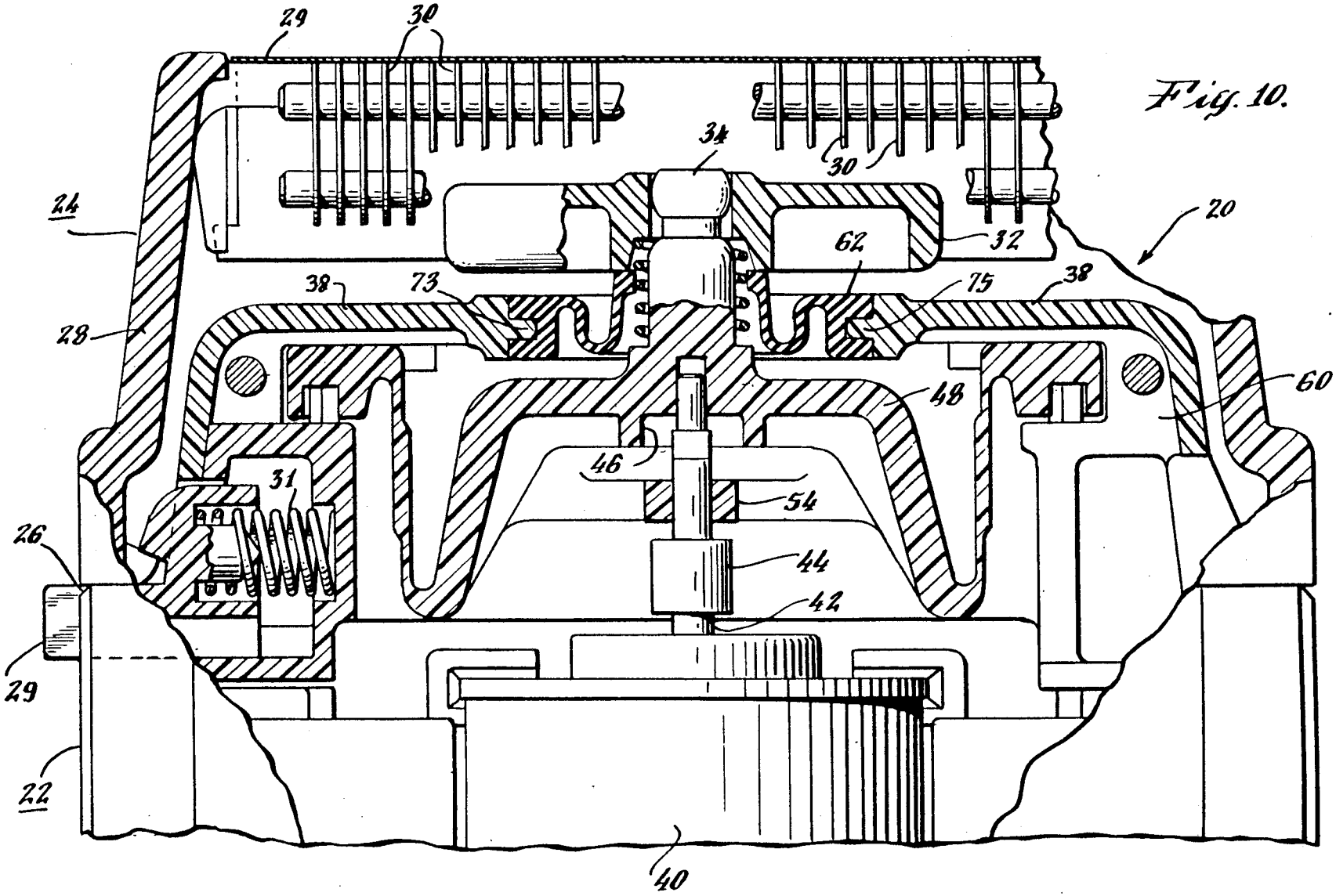

Referring now to the drawings and particularly to FIGS. 9-10, an electric dry shaver 20 is shown to include a housing 22 and a cutter head 24 which is positioned at an end 26 of the housing 22. The shaver 20 illustrated is of the foil type and includes a hair pocket 28 which can be demounted from the housing by a push button 29 which, when depressed, releases a hair pocket latch 31. The hair pocket has mounted thereto an apertured, outer foil 29 which is positioned adjacent to and cooperates with an inner assembly of cutter blades 30 to shear hairs extending through apertures in the foil. The blades 30 are mounted on a blade support 32 which in turn is positioned on and actuated by a drive member 34. Drive member 34 extends through an aperture formed in walls 36 and 38 of the housing 22. An electric motor 40 actuates the assembly of cutter blades 30 through a mechanical coupling which includes a rotary output shaft 42 of the motor, a cam drive member 44 and a cam follower segment 46 of an oscillator body 48. The drive member 34 is integrally formed with the oscillator body 48. This coupling arrangement provides for converting a rotary motion of the motor output shaft 42 to a reciprocating motion of the drive member 34.

A long hair trimmer is also provided and comprises comb and cutter blades 50 and 52, respectively (FIG. 9) which are positioned in a recess of the hair pocket 28. Reciprocating motion of the trimmer cutter blade 52 is obtained through mechanical coupling with the electric motor 40. The cam drive 44 engages a cam follower segment 54 of a second oscillator body 56 which includes an actuating member 58 integrally formed therewith. The actuating member 58 extends through that part of the aperture in the housing formed by wall member 38. Actuating member 58 engages a drive member of the trimmer assembly to cause reciprocation thereof.

Hair shavings and hair trimmings produced by the short hair cutter and the long hair trimmer as well as other foreign substances, as for example pre-shave lotion and powders and the like are prohibited from entering the interior 60 of the housing by a means which comprises a sealing body 62 which is formed of a polymer plastic and preferably is formed of rubber. As best seen in FIG. 1, the sealing body 62 includes peripheral segments having means for engaging edges of the housing walls which define the aperture through which the drive members 34 and 58 extend. As shown in FIG. 1, the engaging means comprises a groove 66 formed in side peripheral segments 68, 70 and 72. The groove 66 of peripheral segments 68 and 72 engages tongue segments 73 and 75 of the housing wall members 36 and 38 (FIG. 10). The groove of peripheral segment 70 engages a tongue segment 77 of the wall member 38 (FIG. 9). The peripheral segment 74 of the body 62 includes a shoulder 76 (FIG. 7) which engages a shoulder 81 of the wall member 36 (FIG. 9). The body 62 (FIG. 1) further includes segments 78 and 80 through which the drive member 34 and the drive member 58 respectively extend. The segment 78 is formed as a cylindrically shaped collar and is sized for snugly engaging the short hair cutter drive segment 34. The segment 80 is generally rectangular shaped and is sized for snugly engaging the trimmer cutter actuating member 58. Segments 78 and 80 are reinforced so that their thicknesses is somewhat greater than that of the immediately surrounding portions 82, 84 (FIG. 6) and 86, 88 (FIG. 7). In addition, the thickness of the body 62 in the area of the peripheral segments 68, 70, 72 and 74 is also increased relative to the thickness of segments 82-88 to provide for forming the groove 66 with the desired gripping capacity for engaging the wall segments as described. The relatively smaller thickness of the segments 82, 84, 86, 88 provides substantial resiliency thereby enabling deflection of the segments 78 and 80 in lateral and in vertical directions without imposing substantial loading on the actuating members which extend therethrough. In particular, the segments 82, 84 are U-shaped so as to provide a hinge and substantial reserve material for extension thus enabling the deflection in lateral directions of the segment 78. Formed in the peripheral segments 68 and 72 are notches or cutouts 90 and 92 which enable a segment 94 (FIG. 3) of the body 62 to be folded over at an angle up to about 90 degrees for sealing that portion of the aperture which is formed in the side wall segment 38 (FIG. 9) of the housing 22. It will be noted from FIG. 9 that the actuating member 58 is positioned closely adjacent to the wall member 38 and the segment 94 facilitates this placement by enabling the drive member 58 to have a desired sealing formed about it and bout the aperture in these relatively close quarters.

The arrangement is advantageous in that the sealing body 62 is impervious not only to hair particles and shaver cuttings but also to fluids and the like, thus preventing buildup and caking of foreign particles. In addition, the segment 78 because of its vertical resiliency can be positioned closely adjacent to a lower surface 94 of the blade carrier 32 (FIG. 9) thereby enhancing the sealing and shielding affect of this arrangement. Because of the resiliency provided by this arrangement, the reciprocating motion of the drive members 34 and 58 in opposite directions does not substantially load the motor 40 which, if such loading did occur in a battery-operated arrangement, would substantially reduce the useful period between required charges.

While there has been described a particular embodiment of the invention, it will be apparent to those skilled in the art that variations may be made thereto without departing from the spirit of the invention and the scope of the appended claims.

What is claimed is:

1. An improved electric dry shaver comprising:

a. an electric dry shaver having a housing;

b. a cutter head positioned at one end of said housing;

c. said cutter head having a short hair cutter and a trimmer;

d. electrically energized actuating means for imparting reciprocating motion to said cutter and to said trimmer;

e. said actuating means including first and second drive members engaging said cutter and trimmer, respectively for reciprocating in mutually opposite directions;

f. said housing having a top wall and a side wall thereof and an aperture formed in said top and side walls at said end of said housing;

g. said drive members extending from within said housing and through said aperture; and, h. a sealing body positioned in the aperture for restricting the passage of shaving debris and foreign material through said aperture into an interior of said housing;

i. said sealing body formed of a resilient material and having first and second segments;

j. first and second apertures formed in said first and second segments, respectively of said sealing body, said apertures sized to provide for the snug extension of said cutter and trimmer drive members, respectively through said first and second apertures, respectively in the sealing body;

k. said sealing body adapted to be folded for sealing said shaver aperture at said top wall and said side wall; and, l. said sealing body including integral, peripheral segments formed for engaging said housing wall, and, integral wall segments of relatively smaller thickness than said aperture segments for coupling said aperture segments to said mounting segments.

2. The electric dry shaver of claim 1 wherein said sealing body includes cutouts formed therein for enabling folding of said body.

3. An improved electric dry shaver comprising:

a. an electric dry shaver having a housing;

b. a cutter head positioned at one end of said housing;

c. said cutter head having a short hair cutter and a trimmer;

d. electrically energized actuating means for imparting reciprocating motion to said cutter and to said trimmer;

e. said actuating means including first and second drive members engaging said cutter and trimmer, respectively;

f. said housing having a wall thereof and an aperture formed in said wall at said end of said housing;

g. said drive members extending from within said housing and through said aperture; and, h. a sealing body positioned in the aperture for restricting the passage of shaving debris and foreign material through said aperture into an interior of said housing;

i. said sealing body formed of a resilient material and having first and second segments;

j. first and second apertures formed in said first and second segments, respectively of said sealing body, said apertures sized to provide for the snug extension of said cutter and trimmer drive members, respectively through said first and second apertures, respectively in the sealing body;

k. said sealing body including integral, peripheral segments formed for engaging said housing wall, and, integral wall segments of relatively smaller thickness than said aperture segments for coupling said aperture segments to said mounting segments; and, l. said segments of relatively smaller thickness formed in a U-shaped configuration for coupling said aperture segments of said sealing body to said peripheral segments of said sealing body.

4. An improved electric dry shaver comprising;

a. an electric dry shaver having a housing;

b. a cutter head positioned at one end of said housing;

c. said cutter head having an array of short hair cutter blades and a trimmer;

d. a support body having a bottom surface thereof;

e. said support body supporting said blade array;

f. electrically energized actuating means for imparting reciprocating motion of said cutter and to said trimmer;

g. said actuating means including first and second drive members engaging said cutter and trimmer, respectively;

h. said housing having a wall thereof and an aperture formed in said wall at said end of said housing;

i. said drive members extending from within said housing and through said aperture; and, j. a sealing body positioned in the aperture for restricting the passage of shaving debris and foreign material through said aperture into an interior of said housing;

k. said sealing body formed of a resilient material and having first and second segments;

l. first and second apertures formed in said first and second segments, respectively of said sealing body, said apertures sized to provide for the snug extension of said cutter and trimmer drive members, respectively through said first and second apertures, respectively in the sealing body;

m. said sealing body including integral, peripheral segments formed for engaging said housing wall, and, integral wall segments of relatively smaller thickness than said aperture segments for coupling said aperture segments to said mounting segments; and, n. said first aperture segment of said sealing body engaging said bottom surface of said blade array.

* * * * *